US009271549B2

(12) United States Patent
Elbe et al.

(10) Patent No.: US 9,271,549 B2
(45) Date of Patent: Mar. 1, 2016

(54) BRACELET FORMED OF HINGED LINKS

(75) Inventors: Mathias Elbe, Glashütte (DE); Giuseppe Anelli, Luino (IT); Michele Bisaro, Maccagno (IT)

(73) Assignee: Glashütter Uhrenbetrieb GmbH, Glashutte/Sachsen (DE)

( * ) Notice: Subject to any disclaimer, the term of this patent is extended or adjusted under 35 U.S.C. 154(b) by 1929 days.

(21) Appl. No.: 12/062,986

(22) Filed: Apr. 4, 2008

(65) Prior Publication Data

US 2008/0245105 A1 Oct. 9, 2008

(30) Foreign Application Priority Data

Apr. 5, 2007 (EP) ..... 07105765

(51) Int. Cl.
*A44C 5/02* (2006.01)
*A44C 5/10* (2006.01)

(52) U.S. Cl.
CPC ..... *A44C 5/107* (2013.01)

(58) Field of Classification Search
CPC ..... A44C 5/107; A44C 5/02; A44C 5/10; F16G 13/00; F16G 13/08
USPC ..... 63/3, 4, 9; 368/282; 59/78, 80, 82, 85; 224/164; 403/22, 101, 359.5, 315–320; 70/129; 292/153; 24/906, 265 WS, 24/265 B
See application file for complete search history.

(56) References Cited

U.S. PATENT DOCUMENTS

| | | | | | |
|---|---|---|---|---|---|
| 3,811,302 | A * | 5/1974 | Sorensen | 70/100 |
| 4,514,996 | A * | 5/1985 | Sjogren | 70/100 |
| 5,083,883 | A * | 1/1992 | Ueda et al. | 403/328 |
| 5,255,993 | A * | 10/1993 | Kovacs | 403/328 |
| 6,079,196 | A * | 6/2000 | Linder et al. | 59/80 |
| 6,406,177 | B1 * | 6/2002 | Fukushima et al. | 368/281 |
| 6,688,800 | B2 * | 2/2004 | Kresge | 403/322.1 |
| 6,727,836 | B2 * | 4/2004 | Jeng | 341/150 |

(Continued)

FOREIGN PATENT DOCUMENTS

| | | | |
|---|---|---|---|
| CH | 594379 | | 1/1978 |
| CH | 594379 AS | * | 1/1978 |
| CH | 676781 AS | * | 3/1991 |

(Continued)

OTHER PUBLICATIONS

European Search Report issued in corresponding application No. EP 07 10 5765, completed Jul. 20, 2007.

(Continued)

*Primary Examiner* — Abigail Morrell
(74) *Attorney, Agent, or Firm* — Oblon, McClelland, Maier & Neustadt, L.L.P.

(57) ABSTRACT

A bracelet includes a plurality of links assembled in an articulated manner using pins. Each pin passes through interlocking parts of links in which a cylindrical passage is arranged where a pin can slide relatively freely. In order to ensure the position of the pin once the links have been assembled, a locking element is arranged in a cavity made in one of the links so as to partially intersect the passage in which the pin is arranged. This pin includes a groove, which is penetrated by an external part of the locking element when the element is in the closed position. Pressing on the locking element, then rotating it by an angle of 90°, releases the external part of the pin groove so that the pin is then released.

5 Claims, 4 Drawing Sheets

(56) References Cited

U.S. PATENT DOCUMENTS 6,823,762 B2 * 11/2004 Hu ..... 81/177.85
6,889,582 B2 * 5/2005 Wilhelm ..... 81/177.85

FOREIGN PATENT DOCUMENTS

EP 0 738 480 A1 10/1996
EP 738480 A1 * 10/1996
GB 2 227 155 A 7/1990
GB 2227155 A * 7/1990

OTHER PUBLICATIONS

Random House Webster's College Dictionary (1991), p. 949.
Random House Webster's College Dictionary 765 and 1004 (1991).

* cited by examiner 12
14
20
22
24
26
28
30
33
34
35
36
37
38
40
42
44
45
46
47,48
49
50
8
X
Y

BRACELET FORMED OF HINGED LINKS

This application claims priority from European Patent Application No. 07105765.7 filed Apr. 5, 2007, the entire disclosure of which is incorporated herein by reference

FIELD OF THE INVENTION

The present invention concerns bracelets with hinged or articulated links, particularly watch bracelets. In other words, the invention concerns bracelets whose links are assembled using pins defining pivoting axes for the links. The pins each pass through at least two partially interlocking or overlapping links.

BACKGROUND OF THE INVENTION

The bracelet pins are inserted into cylindrical passages arranged in the links. In order to ensure assembly of the links, the various pins must be held in place, i.e. to prevent the pins moving transversely to the bracelet once the bracelet links are assembled. Various techniques are known to those skilled in the art for fixedly holding the pins in the respective bracelet passages. Moreover, particularly in order to adjust the length of the bracelet in accordance with the diameter of the wearer's wrist, it is desirable to be able to remove or add at least one link without damaging the bracelet and in an efficient manner, if possible by the user himself.

The present invention proposes in particular providing a reversible system for assembling the links of a bracelet with hinged links, the assembly being provided such that at least one link can easily be added to or removed from the bracelet in order to vary its length.

A watch bracelet formed of several links hinged by means of alternately arranged long pins and short pins is known from GB Patent No. 2 227 155. Each long pin is permanently secured by the first end thereof to a first link. This pin is secured in a reversible manner by the second end thereof to a second link. A screw that partially passes through the passage provided in the second link to allow the second end of the pin to pass forms the reversible securing device. The second end of the pin has a circular groove, which is penetrated by the securing screw. Thus, using a screwdriver, it is possible to assemble the bracelet links by screwing in small screws, which block the long pins.

The bracelet link assembly device proposed in GB Patent No. 2 227 155 is advantageous in that the assembly system is relatively simple and allows links to be added or removed by unscrewing the securing screws provided at the second ends of the long pins. However, this solution has some drawbacks. First of all, the securing screws are very small. A watchmaker is trained to screw and unscrew such small screws, but this is relatively difficult for a mere user. Because of their dimensions, the securing screws are easily lost as soon as they come out of the threaded holes of the second links. Moreover, when the bracelet is worn these screws may become partially unscrewed with the risk of one of the long pins being released and the bracelet then being partially dismantled. For a wristwatch, this solution is to be avoided at all costs.

It is therefore an object of the present invention to propose a bracelet with hinged links assembled in a simple and efficient manner while ensuring that none of the bracelet elements can be lost particularly when alterations are made to the length of the bracelet by adding or removing some links. It is another object of the invention to provide a reversible link assembly device wherein the securing element cannot be loosened by stresses exerted on the bracelet when it is being worn on the wrist.

SUMMARY OF THE INVENTION

The invention therefore concerns a bracelet formed of a plurality of links assembled such that at least a first link of this plurality of links can be separated from the others, this first link being assembled with at least a second link by means of a transverse pin, which is associated with means for locking its transversal position in the bracelet. These locking means are arranged in a reversible manner to allow the pin to be released and the first and second links to be separated. The bracelet is characterized in that said locking means include a locking element which ensures the transversal position of the pin in a first angular position of the locking element and releases the pin along the longitudinal direction thereof in a second angular position, the locking element being arranged in one of the first and second links so that it can be rotated about its axis of rotation, and in that the locking element has a non cylindrical portion, relative to said axis of rotation, one external part of which is located at least partially in a recess arranged at the cylindrical surface of the pin when the locking element is in said first angular position, this non cylindrical portion remaining opposite said pin without penetrating said recess when the locking element is in said second angular position.

According to a particular embodiment of the invention, a truncated cylinder portion forms the non-cylindrical portion of the locking element at least along a plane parallel to the axis of rotation of the locking element.

Preferably, the recess provided in the pin is formed by a groove, in the surface of the pin, centred on the longitudinal axis of the pin.

In a preferred embodiment, the first position of the locking element is ensured by means for locking the angular position thereof, a user being able to activate these locking means in order to allow him to rotate the locking element from the first position to the second position thereof in which the pin is released.

The first position of the locking element thus corresponds to a closed position or locking position of the pin, whereas the second position corresponds to an open position or detached position of the pin and the link in which the locking element is arranged.

According to a preferred variant, the locking element is held in a cavity of the link in which it is arranged by a structure forming a stop member on the side of the external surface of the link.

According to the invention, the locking element forms a sort of lock or cam that remains associated with the link in which it is arranged. This locking element cannot thereof be lost since it cannot be separated from the link concerned.

Thus, in accordance with a first non-limiting embodiment of the invention, a bracelet is provided that is formed of a plurality of links assembled such that at least a first link of the plurality of links can be separated from the others, wherein said first link is assembled with at least a second link by means of a transverse pin, which is associated with first means for locking the transverse pin in the transverse position thereof in the bracelet, wherein the first locking means is arranged in a reversible manner to allow the transverse pin to be released and the first and second links to be separated, wherein the first locking means include a locking element, which ensures the transverse position of the pin in a first angular position of the locking element and releases the transverse pin along the longitudinal direction thereof in a second angular position, wherein the locking element is arranged in one of the first and second links so as to be able to rotate about the axis of rotation thereof, wherein the locking element has a non cylindrical portion, relative to the axis of rotation, wherein one external part of the non cylindrical portion at least partially penetrates a recess arranged in the cylindrical surface of the transverse pin when the locking element is in the first angular position, and wherein the non cylindrical portion remains opposite the transverse pin without penetrating the recess when the locking element is in the second angular position. In accordance with a second non-limiting embodiment of the present invention, the first embodiment is modified so that the non cylindrical portion of the locking element has a lateral wall that has a maximum distance relative to a first geometrical plane, including the axis of rotation, which is less than the maximum distance of the lateral wall relative to a second geometrical plane also including the axis of rotation, the second angular position substantially corresponding to a position of the geometrical plane parallel to the longitudinal axis of the transverse pin and the first angular position substantially corresponding to a position of the second geometrical plane parallel to the longitudinal axis of the transverse pin.

In accordance with a third non-limiting embodiment of the invention, the first embodiment is modified so that the non-cylindrical portion is formed by a truncated cylinder portion at least along a plane parallel to the axis of rotation. In accordance with a fourth non-limiting embodiment of the invention, the first embodiment is modified so that the recess is formed by a groove in the cylindrical surface of the pin, centred on the longitudinal axis of the transverse pin. In accordance with a fifth non-limiting embodiment of the invention, the first embodiment is modified so that the first angular position of the locking element (12) is ensured by second means (14, 16) for locking the angular position thereof, wherein the second locking means is able to be released by a user to allow the locking element to rotate from the first angular position to the second angular position thereof in which the transverse pin is released. In accordance with a sixth non-limiting embodiment of the present invention, the fifth embodiment is further modified so that the locking element is arranged in a cavity of the link in which the locking element is arranged, and wherein the second locking means are formed by the arrangement of a structure in the cavity defining at least two steps at the periphery of the locking element, which are located at two different levels along the axis of rotation of the locking element, and by a spring used to press one shoulder of the locking element against the bottom step in the first angular position such that the user has to exert pressure on the locking element in order to bring the latter into the second angular position in which the shoulder is then against the top step of the structure.

BRIEF DESCRIPTION OF THE DRAWINGS

Other features and advantages of the present invention will also appear from the following detailed description, made with reference to the annexed drawings, given by way of non limiting example, in which.

DETAILED DESCRIPTION OF THE ILLUSTRATIVE EMBODIMENTS

Figure 1:
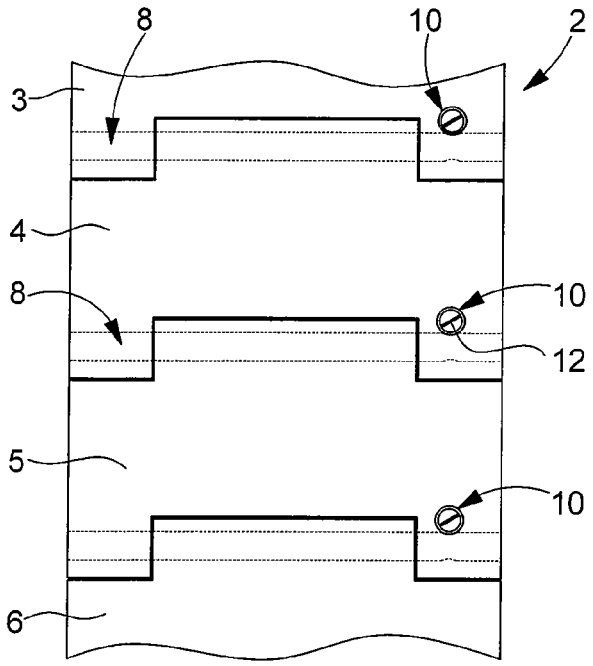
FIG. 1 is a partial bottom view of a bracelet formed of hinged links according to the invention.

With reference to FIGS. 1 to 7, a preferred embodiment of the bracelet according to the present invention will be described below. Bracelet 2 is formed of several interlocking links 3 to 6. An assembly pin 8 passes through the interlocking parts of two adjacent links. When the links are assembled, pins 8 are introduced in cylindrical passages arranged in the interlocking parts of the various links. In order to allow the links of bracelet 2 to be easily assembled and also partially disassembled, particularly to vary the length of the bracelet, the pins slide relatively freely in the transversal passages provided in the links. In order to ensure the transversal position of each pin able to move transversely to the bracelet, i.e. along the longitudinal axis of the pin, means 10 are provided for reversibly locking the pin.

Figure 2:
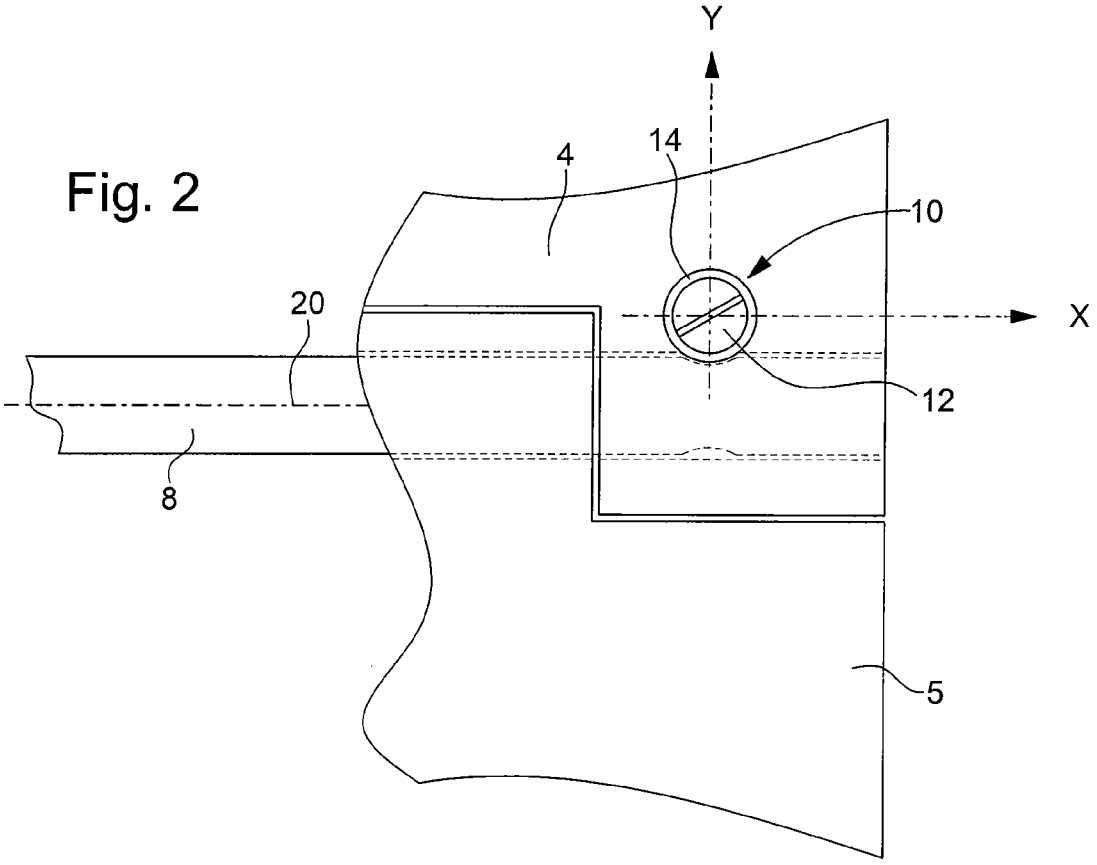
FIG. 2 is a partial enlargement of FIG. 1.

In the variant shown in FIGS. 1 and 2, each pin is used to assemble two links in an articulated manner. However, in other versions of the bracelet with links, it is possible, as in the aforementioned prior art, that one pin is used for assembling more than two links. Depending upon the way in which the links interlock, it is possible that one link has to be associated with two devices for locking the transversal position of the pin to hold the assembled links. In a variant, one end of the pin could be permanently fixed to one of the links. The variant shown in FIGS. 1 and 2 is thus in no way limiting, but precisely describes the means locking the assembly pin transversal position relative to at least one link in which the locking elements are arranged.

Locking device 10 essentially includes three elements, one of which is associated with a recess made in pin 8. Before explaining the operation of the reversible locking device, we will describe each of the constituent parts of the device.

First of all, pin 8 includes a recess 22 defined by a circular groove made in the cylindrical surface of the pin and centred on the longitudinal axis 20 thereof.

Locking device 10 includes three elements 12, 14 and 16 arranged in a cavity 18 provided in particular in link 4 for locking the transversal position of pin 8 in a reversible manner, forming an articulated assembly between link 4 and the adjacent link 5.

Figures 5A, 5B, 6A, 6B, 6C, 7:
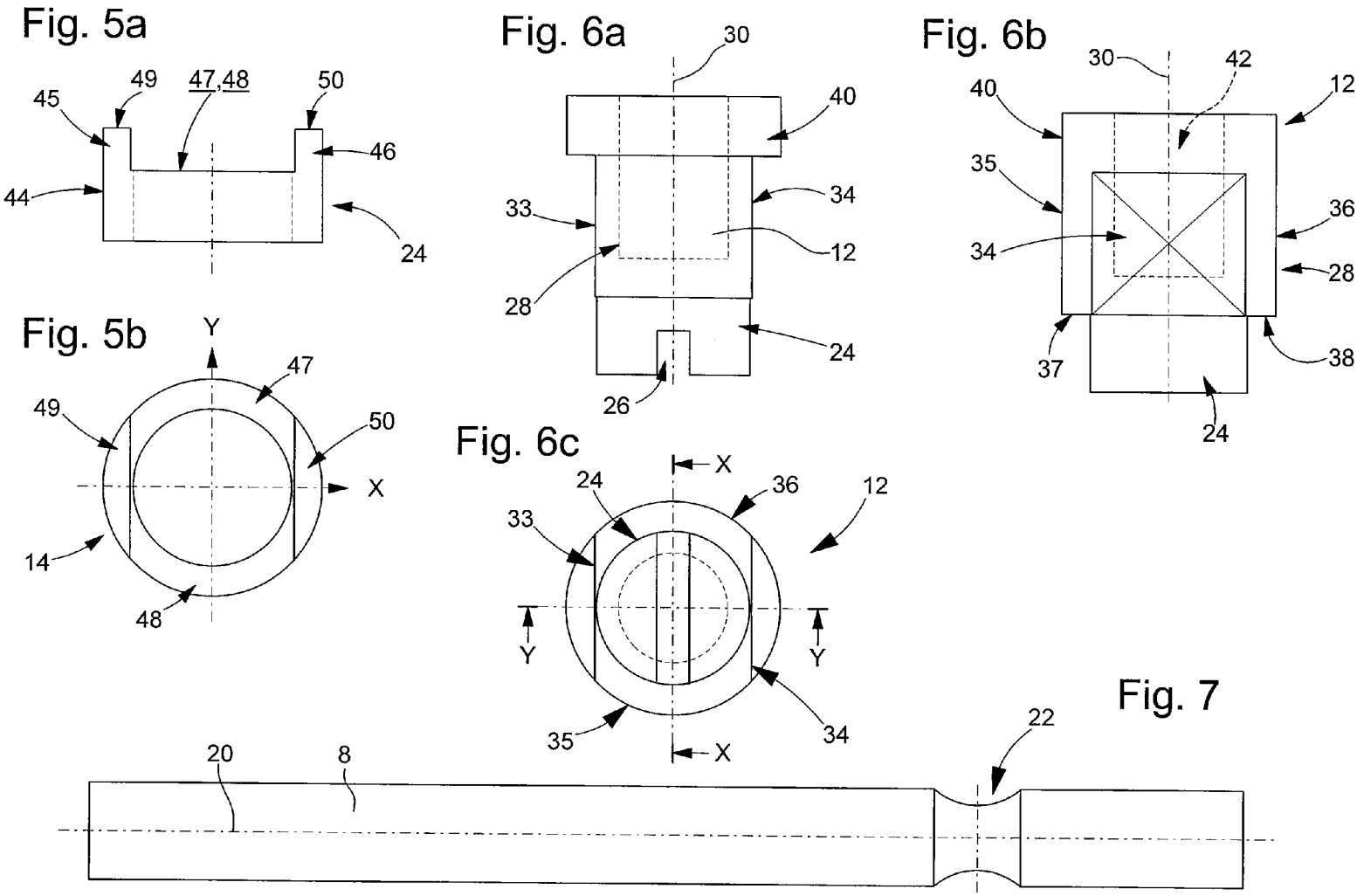
FIGS. 5*a* and 5*b* are respectively side and top views of an external ring of the locking device shown in FIGS. 3 and 4.
FIGS. 6*a*, 6*b* and 6*c* show a locking element in various views.
FIG. 7 shows a pin associated with the locking device according to the invention.

Locking element 12 includes a circular head 24, visible and accessible from the back face of link 4. This head includes a central groove 26 for actuating the locking device in rotation using a screwdriver. Next, element 12 includes a central body formed by a non-cylindrical portion. A truncated cylinder portion forms this non-cylindrical portion 28 at least along a plane parallel to the axis of rotation 30 of element 12, as shown in FIGS. 6*a*, 6*b* and 6*c*. FIG. 6*a* is a side view of the locking element 12 showing opposite plane surfaces 33 and 34. FIG. 6*b* is a different side view of the locking element 12 showing the two cylindrical surfaces of external parts 35 and 36. FIG. 6*b* is a view rotated 90° from FIG. 6*a*. FIG. 6*c* is a top view of the locking element 12 showing all four sides, namely, the two opposite plane surfaces 33 and 34 and the two cylindrical surfaces of the external parts 35 and 36 that form the lateral wall of the locking element 12.

In the present case, the cylinder is machined along two parallel planes defining two diametrically opposite plane surfaces 33 and 34, which corresponds to a non cylindrical portion 28 of the locking element 12, in particular, to a geometry defined more specifically as a "truncated cylindrical portion." These surfaces 33 and 34 are set back relative to the axis of rotation 30 and relative to the two cylindrical surfaces of external parts 35 and 36 remaining between these two plane surfaces. The lateral wall of the non-cylindrical portion is thus formed of four distinct surfaces, namely set back two plane surfaces and two cylindrical surfaces defining two external parts 35 and 36 of the locking element. In other words, the locking element includes a lateral wall (see, e.g., FIG. 6*c*), wherein the lateral wall includes the two diametrically opposite plane surfaces 33, 34 of the non-cylindrical portion and two cylindrical surfaces of the non-cylindrical portion, wherein the two cylindrical surfaces define two external parts 35, 36 of the locking element. Finally, this element 12 includes an end part 40. This end part is circular with a lateral surface whose radius at the centre corresponds to that of the external parts 35 and 36. A recess 42 is made in element 12 from the end part 40 to house therein a spring 16 for pressing the element against structure 14 partially closing cavity 18.

It will be noted first of all that, within the scope of the present invention, a single surface 34 set back from another lateral surface 36 relative to axis of rotation 30 is sufficient for the operation of the locking device described here. However, the presence of the two diametrically opposite plane surfaces 33 and 34 facilitates manipulation of the device for a user. In order to ensure that locking element 12 works in association with groove 22 made in pin 8, the non cylindrical portion of the locking element only needs to have a lateral wall that has a maximum distance relative to a first geometrical plane X-X, including axis of rotation 30, which is less than the maximum distance from this lateral wall relative to a second geometrical plane Y-Y also including axis of rotation 30 (see FIG. 6*c*). Thus, as will become clear below in the description of the operation of the locking device with reference to FIGS. 3 and 4, in the open position the locking element has an angular position substantially corresponding to a position of said geometrical plane parallel to the longitudinal axis 20 of pin 8, whereas the closed position of this locking element for releasing the pin corresponds to another angular position in which said second geometrical plane is substantially parallel to the longitudinal axis of the pin.

Structure 14 is used for partially closing aperture 18 in link 4 so as to hold locking element 12 in the cavity. It therefore forms a stop member for two shoulders 37 and 38 of the locking element defined by the external parts 35 and 36 whose radius at the centre is greater than the radius of head 24. Structure 14 forms a ring whose central aperture has a radius adjusted to the radius of head 24 of element 12. Structure 14 is formed of an annular base 44 on which two projecting parts 45 and 46 are mounted diametrically opposite relative to the central axis of the structure, which is identical to axis of rotation 30 of the locking element. Structure 14 defines two bottom steps 47 and 48 and two top steps 49 and 50. For shoulders 37 and 38 of the locking element, structure 14 thus defines four different angular positions, shifted by 90°. It will be noted that the structure, axially forming a stop member for the locking element, only needs to have two steps at the periphery of the locking element and located at two different levels along the axis of rotation of the locking element. These two steps must be arranged to allow one shoulder of the locking element to be pressed by spring 16 against the bottom step when it is in the closed position, whereas it is pressed against the top step when the locking element is in the open position, such that a user has to exert pressure on the locking element to bring it from the closed position, where the pin is locked, to the open position, where the pin is released.

Figure 3A:
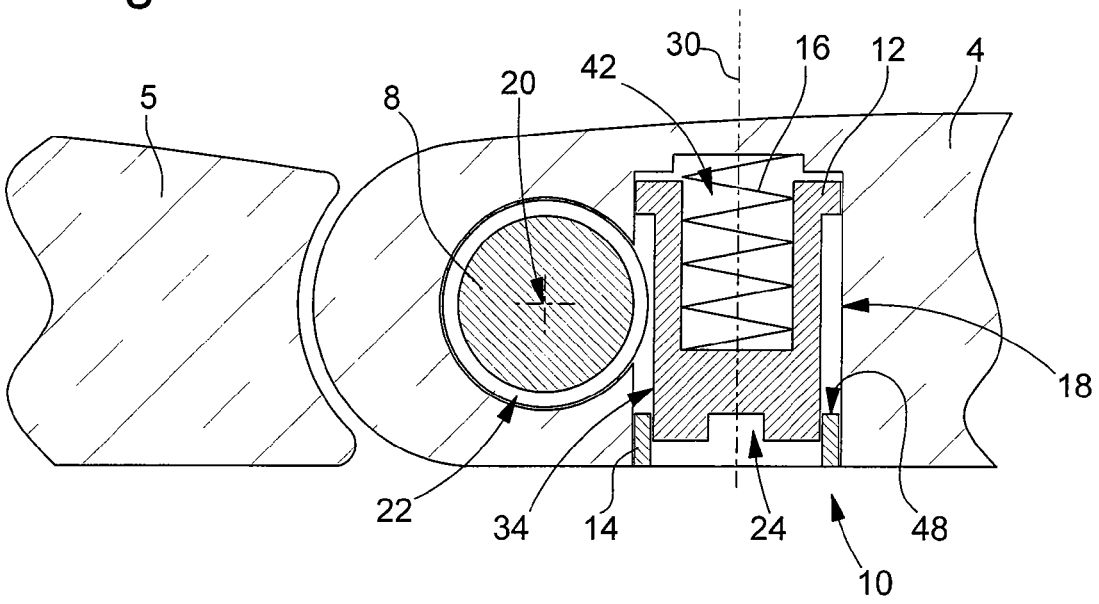
FIGS. 3*a* and 3*b* are cross-sections of FIG. 2, respectively along two orthogonal planes, showing the reversible locking device for a link assembly pin in the open position thereof.
Figure 3B:
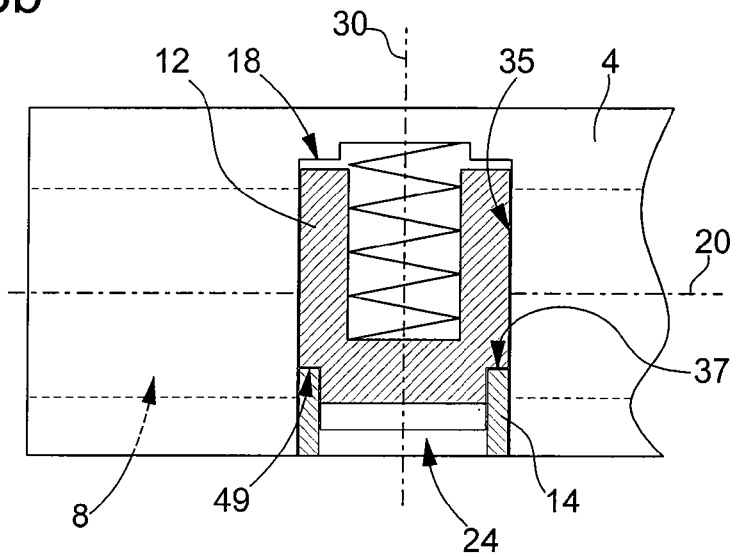
Figure 4A:
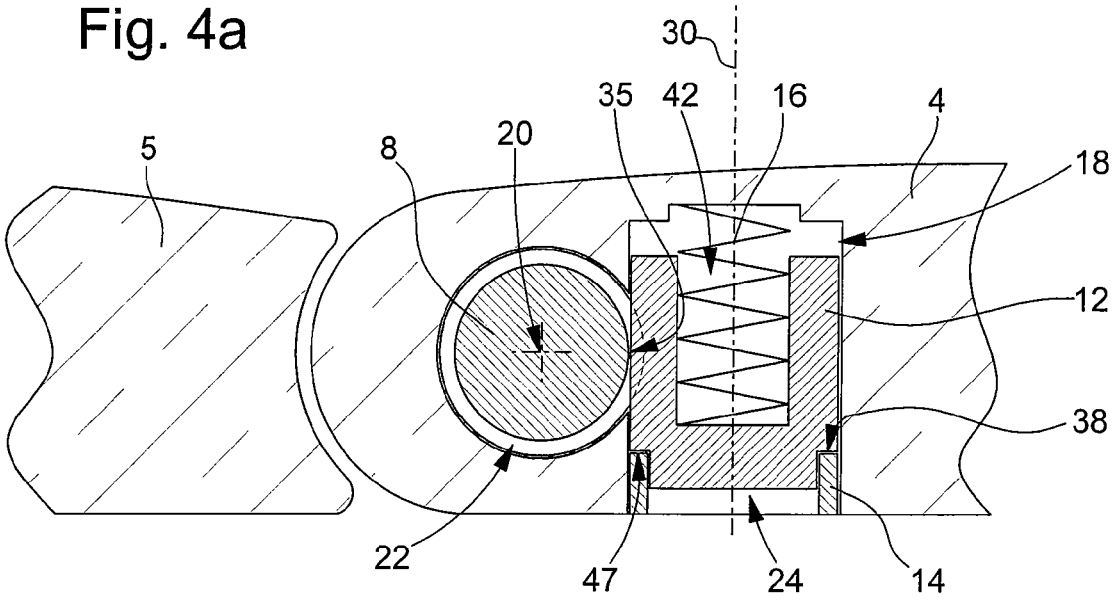
FIGS. 4*a* and 4*b* are cross-sections respectively along two orthogonal planes showing the reversible locking device, shown in FIGS. 3*a* and 3*b*, in the closed position thereof.
Figure 4B:
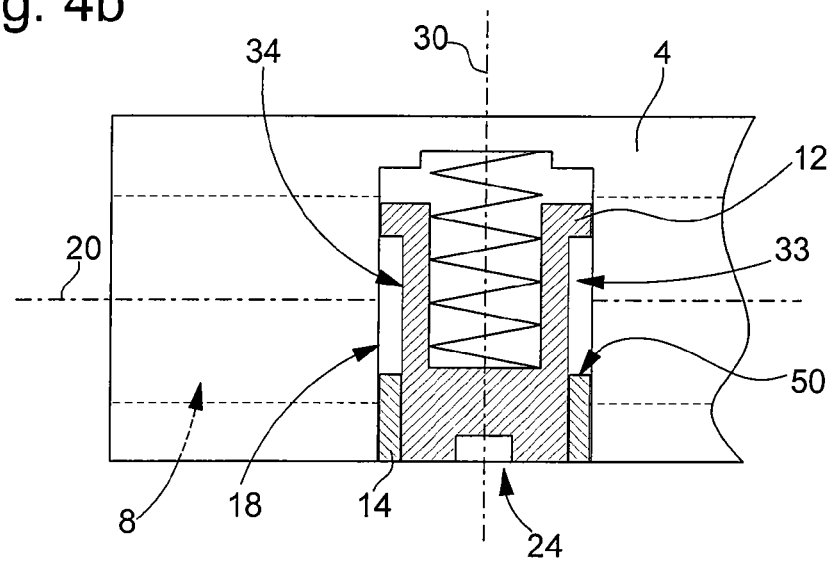

With reference to FIGS. 3 and 4, the operation of the locking device according to the preferred embodiment of the invention will be described below. It will be noted that FIGS. 3*a* and 3*b* show the locking element in an open position, FIG. 3*b* being a cross-section perpendicular to that of FIG. 3*a*. Moreover, FIGS. 4*a* and 4*b* are also orthogonal views similar to FIGS. 3*a* and 3*b*, but with the locking element in a closed position.

Cavity 18 opens out onto the bottom surface of the link in which it is machined. This cavity 18 thus defines a blind hole in which locking element 12 is arranged with spring 16 placed in its central hole 42. Spring 16 thus pushes element 12 in the direction of the external aperture of cavity 18. To prevent element 12 being able to leave the latter, the annular structure 14 is arranged on the side of the opening of cavity 18 at the periphery of the locking element such that its head 24 is located in the central aperture of structure 14 and that at least one external shoulder of element 12 is stopped against a horizontal surface of structure 14, whatever the angular position of the locking element. More specifically, in the situation where the locking element has an angular position corresponding to the open position of the locking device, as shown in FIGS. 3*a* and 3*b*, the two shoulders 37 and 38 of the locking element abut against the two top steps 49 and 50 of structure 14. It will be noted that the set of steps of structure 14 and the set of lateral surfaces of element 12 have not been referenced in all of the Figures to avoid overloading the drawings. In the open position, the locking element is slightly pushed into cavity 18, the plane lateral surface 34 thereof being located opposite pin 8. In this open position, locking element 12 does not penetrate groove 22 of pin 8. Thus, this pin can be moved freely transversely, i.e. along the longitudinal axis 20. In this position, the non-cylindrical portion 28 of element 12 is located opposite pin 8 without however penetrating recess 22 thereof. In other words, the open position of the locking element corresponds to a parallel orientation of plane surfaces 33 and 34 to longitudinal axis 20 of pin 8. These surfaces 33 and 34 are set back sufficiently that they do not intersect the section of pin 8 over its entire length, in projection into the cross-sectional plane of FIG. 3*a*.

In order to pass from the open position of FIG. 3 to the closed position of FIG. 4, locking element 12 must be rotated by an angle of 90°, particularly using a screwdriver inserted into the groove of head 24. During this rotation, on the one hand, the external part 35 of element 12 at least partially penetrates groove 22 of pin 8, which has the effect of locking the latter. On the other hand, shoulders 37 and 38 of element 12 undergo an angular shift relative to the top steps 49 and 50 of structure 14 until they finally descend one level via the action of spring 16 to abut against the two bottom steps 47 and 48 of structure 14. In this closed position, head 24 of element 12 is substantially flush with the external surface of link 4. Moreover, element 12 is locked in the position locking pin 8 by structure 14 and spring 16 which presses element 12 against the structure. Structure 14 and spring 16 thus form means locking the closed position of element 12. These locking means for element 12 are arranged to allow a user to release element 12 in rotation by pressing on head 24 to allow the shoulders of element 12 to pass from a bottom level, corresponding to the bottom steps of structure 14, to a top level corresponding to the top steps of structure 14. Next, via a movement of rotation of element 12, the user can bring the locking element into its open position in which the pin is then released. However, without the deliberate intervention of the user, the action of spring 16 on element 12 ensure that the latter remains in the locking position after the bracelet links have been mounted.

Generally, the means used for locking the pin locking element are formed by the arrangement of a structure in cavity 18 defining at least two steps at the periphery of the locking element, which are located at two different levels along axis of rotation 30 of the locking element, and by a spring 16 used to press one shoulder of the locking element against the bottom step when the locking element has an angular position corresponding to the closed position, i.e. in a position preventing the pin from moving along its longitudinal axis.

It will also be noted that the term "link" used must be understood in the widest sense to include any intermediate element between other links and elements of the bracelet that are not visible on the top thereof.

In another particular embodiment of the invention, a single locking device placed between two close passages is used to lock or release two neighbouring pins respectively arranged in these two passages. Thus, the invention is not limited to any single embodiment shown in the Figures.

In sum then, the present invention pertains broadly to a bracelet that is formed of a plurality of links (4, 5) assembled in an articulated manner by means of pins (8). Each pin passes through the interlocking parts of links in which a cylindrical passage is arranged where a pin can slide relatively freely. In order to ensure the position of the pin once the links have been assembled, a locking element (12) is arranged in a cavity (18) made in one of the links so as to partially intersect the passage in which the pin is arranged. This pin includes a groove (22), which an external part (35) of the locking element penetrates when the element is in the closed position. Pressing on the locking element, then rotating it through an angle of 90°, releases the external part of the pin groove so that the pin is then released. The pin locking device thus allows the links to be assembled in a reversible manner and the length of the bracelet may be varied by adding or removing at least one link.

What is claimed is:

1. A bracelet, comprising:

a plurality of links assembled so that at least a first link of the plurality of links is separable from other links of the plurality of links, wherein the first link is assembled with at least a second link of the plurality of links by a transverse pin, wherein the transverse pin is associated with first means for locking the transverse pin in a transverse position thereof in the bracelet, wherein the first locking means is arranged in a reversible manner to allow the transverse pin to be released and the first link to be separated from the second link, wherein the first locking means includes a locking element that ensures the transverse position of the transverse pin in a first angular position of the locking element and releases the transverse pin along a longitudinal direction thereof in a second angular position, wherein the locking element is arranged in the first link so as to rotate about an axis of rotation thereof, wherein the locking element has a non cylindrical portion, relative to the axis of rotation, wherein one external part of the non cylindrical portion at least partially penetrates a recess arranged in a cylindrical surface of the transverse pin when the locking element is in the first angular position, and wherein the non cylindrical portion remains opposite the transverse pin without penetrating the recess when the locking element is in the second angular position, wherein the first angular position of the locking element is ensured by a second means for locking the angular position thereof, wherein the second locking means is releasable by a user to allow the locking element to rotate from the first angular position to the second angular position thereof in which the transverse pin is released, and wherein the locking element is arranged in a cavity of the first link, and wherein the second locking means is formed by arrangement of a structure in the cavity defining at least two steps at a periphery of the locking element that are located at two different levels along the axis of rotation of the locking element, and the at least two steps include a bottom step and a top step, wherein a spring is disposed to press one shoulder of the locking element against the bottom step in the first angular position so that the user has to exert pressure on the locking element in order to bring the locking element into the second position in which the shoulder is then disposed against the top step of the structure.

2. A bracelet, comprising:

a plurality of links assembled so that at least a first link of the plurality of links is separable from other links of the plurality of links, wherein the first link is assembled with at least a second link of the plurality of links by a transverse pin, wherein the transverse pin is associated with first means for locking the transverse pin in a transverse position thereof in the bracelet, wherein the first locking means is arranged in a reversible manner to allow the transverse pin to be released and the first link to be separated from the second link, wherein the first locking means includes a locking element that ensures the transverse position of the transverse pin in a first angular position of the locking element and releases the transverse pin along a longitudinal direction thereof in a second angular position, wherein the locking element is arranged in the second link so as to rotate about an axis of rotation thereof, wherein the locking element has a non cylindrical portion, relative to the axis of rotation, wherein one external part of the non cylindrical portion at least partially penetrates a recess arranged in a cylindrical surface of the transverse pin when the locking element is in the first angular position, and wherein the non cylindrical portion remains opposite the transverse pin without penetrating the recess when the locking element is in the second angular position, wherein the first angular position of the locking element is ensured by a second means for locking the angular position thereof, wherein the second locking means is releasable by a user to allow the locking element to rotate from the first angular position to the second angular position thereof in which the transverse pin is released, and wherein the locking element is arranged in a cavity of the second link, and wherein the second locking means is formed by arrangement of a structure in the cavity defining at least two steps at a periphery of the locking element that are located at two different levels along the axis of rotation of the locking element, and the at least two steps include a bottom step and a top step, wherein a spring is disposed to press one shoulder of the locking element against the bottom step in the first angular position so that the user has to exert pressure on the locking element in order to bring the locking element into the second position in which the shoulder is then disposed against the top step of the structure.

3. A bracelet, comprising:

a plurality of links assembled so that at least a first link of the plurality of links is separable from other links of the plurality of links, wherein the first link is assembled with at least a second link of the plurality of links by a transverse pin, wherein the transverse pin is associated with first means for locking the transverse pin in a transverse position thereof in the bracelet, wherein the first locking means is arranged in a reversible manner to allow the transverse pin to be released and the first link to be separated from the second link, wherein the first locking means includes a locking element that ensures the transverse position of the transverse pin in a first angular position of the locking element and releases the transverse pin along a longitudinal direction thereof in a second angular position, wherein the locking element is arranged in one of the first link and the second link so as to rotate about an axis of rotation thereof, wherein the locking element has a non-cylindrical portion, relative to the axis of rotation, wherein one external part of the non-cylindrical portion at least partially penetrates a recess arranged in a cylindrical surface of the transverse pin when the locking element is in the first angular position, and wherein the non-cylindrical portion remains opposite the transverse pin without penetrating the recess when the locking element is in the second angular position, wherein the locking element comprises i. a circular head;

ii. a central body connected to the circular head, wherein the central body includes the non-cylindrical portion that comprises a cylinder machined along two parallel planes so as to define two diametrically opposite plane surfaces;

iii. an end part attached to the central body, wherein a recess is disposed in the end part, and a spring is housed in the recess; and iv. a central groove disposed in the circular head.

4. The bracelet according to claim 3, wherein the locking element further comprises an external surface comprising a lateral wall, wherein the lateral wall includes the two diametrically opposite plane surfaces of the non-cylindrical portion and two cylindrical surfaces of the non-cylindrical portion, wherein the two cylindrical surfaces define two external parts of the locking element.

5. The bracelet according to claim 3, wherein the locking element is arranged in a cavity disposed in the first link so as to rotate about the axis of rotation thereof, and the bracelet further comprises an annular structure disposed in the cavity at an opening of the cavity so that the circular head of the locking element is disposed in a central aperture of the annular structure.

* * * * *